US006743311B2

(12) United States Patent
Nishigori et al.

(10) Patent No.: US 6,743,311 B2
(45) Date of Patent: Jun. 1, 2004

(54) FORGING METHOD

(75) Inventors: Sakae Nishigori, Yasu-gun (JP); Nobuyasu Nishihata, Kusatsu (JP)

(73) Assignee: Gohsyu Corporation, Shiga (JP)

( * ) Notice: Subject to any disclaimer, the term of this patent is extended or adjusted under 35 U.S.C. 154(b) by 0 days.

(21) Appl. No.: 09/974,916

(22) Filed: Oct. 12, 2001

(65) Prior Publication Data

US 2002/0069946 A1 Jun. 13, 2002

(30) Foreign Application Priority Data

Oct. 25, 2000 (JP) ..... 2000-367820
Feb. 14, 2001 (JP) ..... 2001-083839
Jun. 29, 2001 (JP) ..... 2001-237165

(51) Int. Cl.[7] ..... C21D 8/00
(52) U.S. Cl. ..... 148/649; 148/654; 148/663
(58) Field of Search ..... 148/649, 663

(56) References Cited

U.S. PATENT DOCUMENTS 4,812,182 A * 3/1989 Fang et al. ..... 148/330
5,601,667 A * 2/1997 Takahashi et al. ..... 148/649
6,162,307 A * 12/2000 Hasegawa et al. ..... 148/649

* cited by examiner

*Primary Examiner*—Deborah Yee
(74) *Attorney, Agent, or Firm*—Wenderoth, Lind & Ponack, L.L.P.

(57) ABSTRACT

The objective of the present invention is to provide a forging method that improves workability in machining, by turning the metallographical structure of products subject to impact load to a fine ferrite-perlite structure, without adopting the method of quenching and tempering, to obtain, as strength, a yield point (YP value) exceeding that obtained by the method of quenching and tempering, and making the tensile strength (TS) smaller compared with the method of quenching and tempering. A material to be forged has at least one kind of group 5 metal added thereto and is heated to a temperature suitable for hot forging. After forging to prescribed shape, cooling, and holding for a prescribed set time in a furnace at a tempering temperature, the material is further cooled to normal temperature by natural cooling.

2 Claims, 4 Drawing Sheets

【Fig. 1】
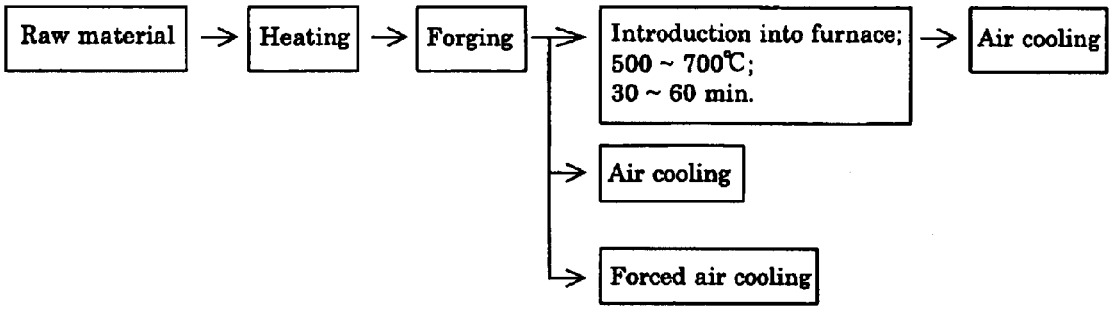

【Fig. 2】
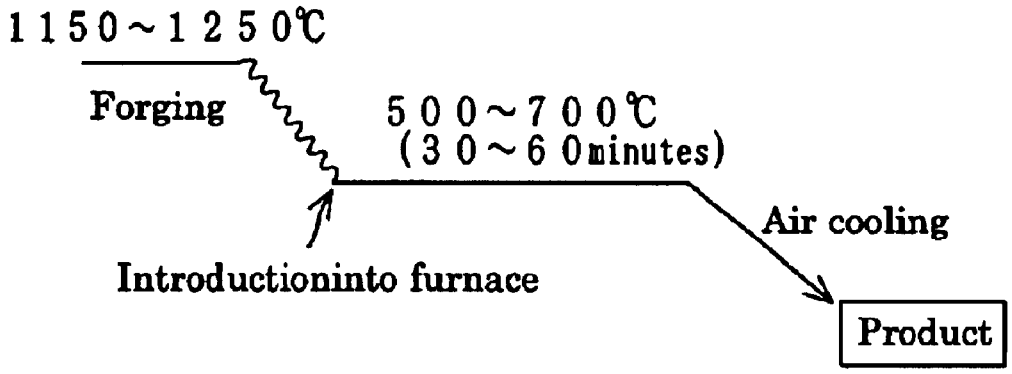

【Fig. 3】
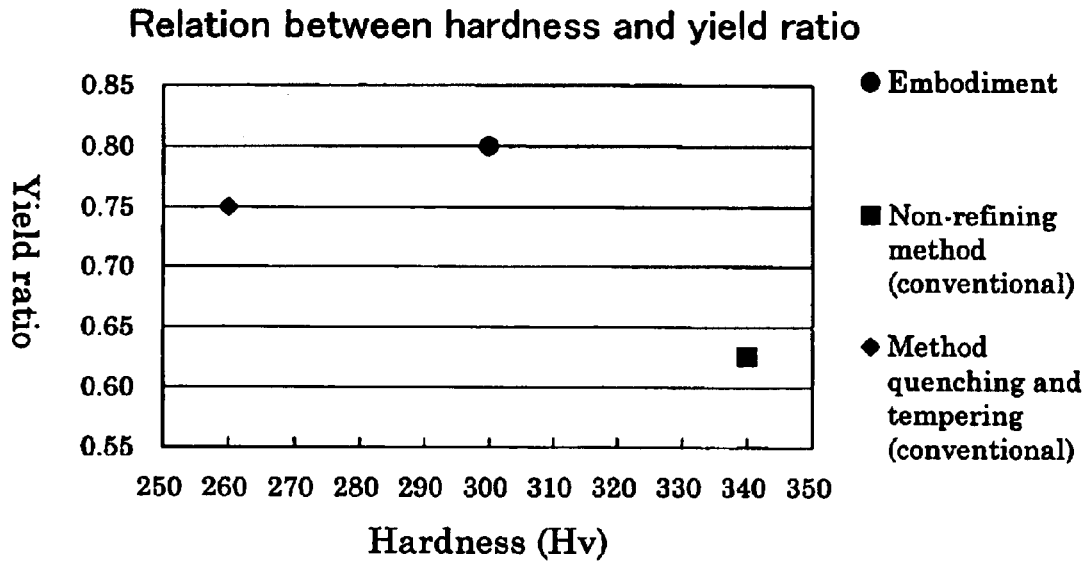

【Fig. 4】
(A)
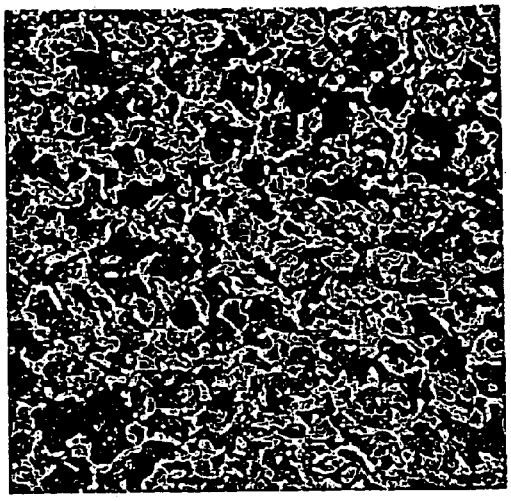
(B)
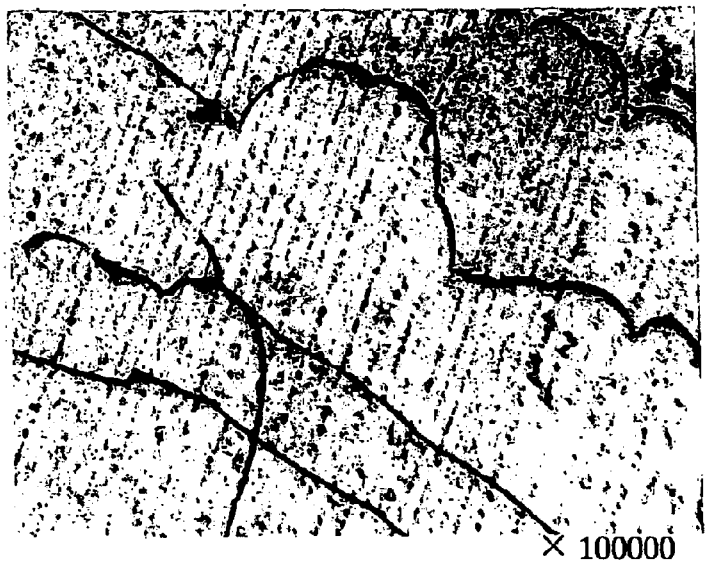
(C)
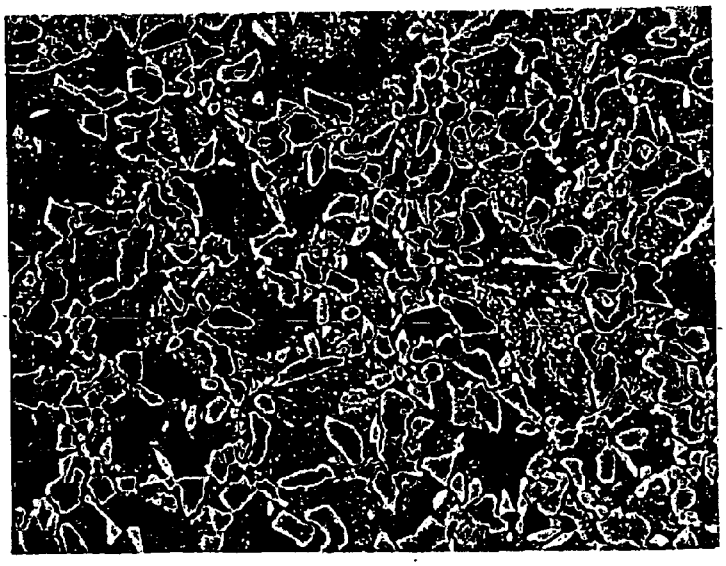

FORGING METHOD

BACKGROUND OF THE INVENTION

The present invention relates to a forging method, more specifically a forging method that improves workability in machining by turning the metallographical structure of products subject to impact load to a fine ferrite-perlite structure, without adopting the method of quenching and tempering, to obtain as strength a yield point (YP value) exceeding that by the method of quenching and tempering, and making the tensile strength (TS) smaller than that obtained by the method of quenching and tempering.

Conventionally, products subject to impact load such as connecting rod, steering knuckle, crankshaft, etc., for example, used to be manufactured by forging.

Further, for the manufacturing of a connecting rod, which is momentarily subject to a large impact load, the method of quenching and tempering was also used in combination with forging, to increase its strength.

However, this method of quenching and tempering not only requires a high manufacturing cost but also is unfit for products mass-produced at low cost like automobile parts, for example, today when reduction of manufacturing cost is strongly called for. For that reason, a non-refining method capable of reducing manufacturing cost is coming to be adopted in place of the method of quenching and tempering.

This non-refining method consists of forcibly air cooling, after forging, high-temperature products from around 1200° C. immediately to around 500° C.

By the way, with the non-refining method by which high-temperature products at around 1200° C. are forcibly air cooled, after forging, immediately to around 500° C., the yield point (YP value) drops although the tensile strength (TS) remains at about the same level as with the method of quenching and tempering, and its value expressed by dividing the yield point by the tensile strength, i.e. value expressed in yield ratio (YR) is approximately 0.6. For that reason, this drop of yield point (YP value) as compared with the method of quenching and tempering puts an obstacle to reduction of weight of forged projects, while on the other hand a high tensile strength (TS) still remaining at about the same level as in the method of quenching and tempering means poor workability in machining in the same way as products manufactured by the method of quenching and tempering, and such were problems with the non-refining method.

SUMMARY OF THE INVENTION

In view of the problems with conventional forging methods, the objective of the present invention is to provide a forging method that improves workability in machining by turning the metallographical structure of products subject to impact load into a fine ferrite-perlite structure, without adopting the quenching and tempering method, to obtain, as strength, a yield point (YP value) exceeding that obtained by the quenching and tempering method, and reducing the tensile strength (TS) compared to the quenching and tempering method.

To achieve said objective, the forging method according to the present invention is characterized in that a forged material is manufactured by adding at least one kind of group metal, (or group VB metals), to a material to be forged, heating to a temperature suitable for hot forging, forging to a prescribed shape, cooling, holding for a prescribed set time in a furnace at a tempering temperature, and then further cooling to normal temperature by natural cooling.

In accordance with the present invention, it is desirable to set the "tempering temperature" at a temperature in the range of 500~700° C. and the "prescribed set time" for 30~60 minutes.

In this forging method, a forged material manufactured by adding at least one kind of group 5 metal to metal material consisting of perlite, ferrite, etc., which are usually used as forged materials, is heated to a temperature suitable for hot forging, is forged to a prescribed shape, is cooled, is then held for a prescribed set time in a furnace at a tempering temperature, and is then further cooled to normal temperature by natural cooling. Accordingly, group 5 metals such as vanadium, niobium, etc. that were added to the forged material can precipitate, on ferrite, fine carbon nitride mainly comprised of added elements, and thereby enable the setting of a high yield point (YP value) with high rigidity and strong resistance to impact load because of the fine metallographical structure of fine ferrite+perlite. The present invention therefore makes possible to reduce the weight of forged products, control a low tensile strength (TS), and thanks to the fine metallographical structure of fine ferrite+perlite, improve workability in machining, thus promoting the reduction of manufacturing costs for forged products.

In accordance with the present invention, the heating temperature of the forged material shall preferably be set in the range of 1150~1250° C.

This promotes melting into a solid solution of group 5 metals such as vanadium, niobium, etc. that were added to the forged material. When they have cooled and precipitated, the texture of the forged material is strained with the precipitate, and precipitates as a large volume of fine carbon nitride, while the strength of the forged material increases because the metallographical structure becomes fine.

BRIEF DESCRIPTION OF THE DRAWINGS

FIG. 1 is an explanatory drawing of an exemplary embodiment of a forging process according to the present invention.

FIG. 2 is an explanatory drawing of temperature changes in the same forging process of FIG. 1.

FIG. 3 is a graph showing the relations of hardness and yield rate between an embodiment of the present invention and conventional products (conventional non-refining method and conventional method of quenching and tempering).

FIGS. 4(A)–4(C) show microscopic pictures of metallographical texture, wherein FIG. 4(A) is a microscopic picture of the metallographical texture of the embodiment of the present invention expanded at a magnification of 400. FIG. 4(B) is a microscopic picture of the same expanded at a magnification of 100000, and FIG. 4(C) is a microscopic picture of the metallographical texture of a conventional product (conventional non-refining method) expanded at a magnification of 400, respectively.

DETAILED DESCRIPTION OF THE INVENTION

An embodiment of the forging method according to the present invention will be explained below based on drawings.

FIG. 1 and FIG. 2 indicate processes of the forging method of the present invention.

Generally, products like automobile parts, etc. momentarily subject to impact load such as connecting rod, steering knuckle, crankshaft, etc., for example, used to be manufactured by a method of forging, which is a method suitable for high strength, low cost and mass production.

The present invention improved the conventional method. In particular, in the present invention, a forged material, manufactured by adding at least one kind of group 5 metal such as vanadium, niobium, tantalum dubnium, etc. to metal material consisting of perlite, ferrite, etc., which are usually used as forged material, is heated to a temperature suitable for hot forging. The combined material is then forged to prescribed shape, cooled, held for a prescribed set time in a furnace at a tempering temperature and further cooled to normal temperature by natural cooling.

In the exemplary embodiment preferable non-limiting examples of group 5 metals include vanadium or niobium which are easy to obtain and inexpensive.

Further, the added volume of the group 5 metal may be very small, for example, about 0.03 to 0.3 wt % as compared with the forged material.

When hot forging by using this forged material, the heating temperature shall be set slightly lower than the heating temperature suitable for conventional hot forging (this heating temperature varies also depending on the type of forged material) or, for example, at about 1200° C.±50° C., in the case where the heating temperature suitable for conventional hot forging is around 1250° C.

By setting the heating temperature of forged material as described above, it becomes possible to promote melting into solid solution of group 5 metals such as vanadium, niobium, etc., that were added to the forged material. Further, when the group 5 metals cool and precipitate, the texture of the forged material is strained with the precipitate and precipitates as a large volume of fine carbon nitride, increasing the strength of the forged material.

And, this forged material, heated to a temperature suitable for hot forging, is molded to a prescribed shape by hot forging using dies.

This hot forging process is the same as that in the conventional non-refining method and method of quenching and tempering.

After the forging, the forged product released from the die is cooled, by natural cooling, to a temperature close to the temperature at which group 5 metals, such as vanadium, niobium, etc., can easily precipitate, on the ferrite, as fine carbon and nitrides that include mainly the added elements. This cooling temperature, which is not particularly restricted, will be set for approximately 600 to 800° C.

This natural cooling may be made naturally during conveyance on the conveyor where the forged products discharged from the forging system are carried continuously to the heating furnace of the subsequent process, or made forcibly by such means as blowing air with a blower to the forged products on the conveyor, etc. These methods can be adopted selectively as required, depending on the carrying distance from forging system to heating furnace, required carrying time, etc.

In this way, forged products cooled to approximately 600 to 800° C. are supplied into the heating furnace.

It is so arranged that, in this heating furnace, the forged products can maintain a temperature, for example, in the tempering temperature area or 500 to 700° C.

In this case, since the thermal energy of the forged products supplied into the heating furnace is set slightly higher than the temperature in the heating furnace, the set temperature is maintained in the heating furnace without hardly any heating except in the early period of operation, enabling energy-saving treatment (of the forged products).

The holding time of this tempering temperature will be set for a time necessary for the group 5 metals such as vanadium, niobium, etc. to precipitate, on the ferrite, as fine carbon and nitrides that include mainly the added elements, for 30 to 60 minutes or so, for example.

In that case, use of a heating furnace is not always necessary, if it is possible to maintain the prescribed temperature during the time necessary for precipitating, on the ferrite, as fine carbon and nitrides that include mainly the added elements, by using an oven such as heat insulating oven, etc.

As described above, after the forged products are maintained at 500° C. to 700° C. in the heating furnace for approximately 30 to 60 minutes, to make the group 5 metals such as vanadium, niobium, etc. precipitate, on the ferrite, as fine carbon and nitrides that include mainly the added elements, the forged products are taken out from the heating furnace, and cooled to normal temperature by natural cooling, into products.

This makes it possible to realize a fine metallographical structure close to that obtained by normalizing and set a high yield point (YP value) for high rigidity and strong resistance to impact load, and to thus sharply improve the yield ratio (YR). As a result, reduction of weight can be achieved and yet the tensile strength (TS) can be controlled low, thereby obtaining forged products with improved workability in machining.

Table 1 and Table 2 indicate differences between the non-heat treated carbon steel for machine structure (S35C) to which are added 0.26% vanadium and 0.026% niobium of an embodiment of the forging method according to the present invention and conventional products (products by conventional non-refining method and conventional method of quenching and tempering (carbon steel for machine structure with equivalent carbon content (S40) (Table 2 (A)) and with equivalent strength value (S55C) (Table 2 (B)))).

TABLE 1

| Item | Present invention | Non-refining method |
|---|---|---|
| Heating temperature for forging | 1220° C. | 1220° C. |
| Supply temperature for heating furnace after natural cooling | 800° C. | Blast cooling (to 500° C.), and air cooling after that |
| Set temperature in heating furnace | 600° C. | |
| Set temperature holding time | 30 minutes | |

TABLE 2

| Item | Present invention | Non-refining method | Method of quenching and tempering (A) | Method of quenching and tempering (B) |
|---|---|---|---|---|
| Tensile strength ($N/mm^2$) | 1140 | 1162 | 782 | 962 |
| Yield point ($N/mm^2$) | 892 | 733 | 585 | 710 |
| Yield ratio (YR) | 0.78 | 0.63 | 0.75 | 0.74 |
| Elongation | 11.6 | 13.7 | 23.8 | 20.0 |
| Reduction of area | 19.2 | 19.6 | 63.8 | 54.4 |
| Texture | Ferrite + Perlite | Ferrite + Bainite | Sorbite | Sorbite + Ferrite |
| Treating method | As described in the Specification | Same as left | 842° C. Water cooling 538° C. Tempering | Same as left |
| Remarks | V 0.26% Nb 0.026% Non-heat treated steel | Same as left | S40C | S55C |

For the method of quenching and tempering, data were borrowed from ASME Hand Book (1954).

FIG. 3 indicates the relations of hardness and yield rate between an embodiment of the present invention and a conventional product (conventional non-refining method and conventional method of quenching and tempering).

FIGS. 4(A)–4(C) show microscopic pictures of metallographical texture.

FIG. 4(A) is a microscopic picture of the metallographical texture of the embodiment of the present invention expanded at a magnification of 400, FIG. 4(B) is a microscopic picture of the same expanded at a magnification of 100000, and FIG. 4(C) is a microscopic picture of the metallographical texture of a conventional product (conventional non-refining method) expanded at a magnification of 400 respectively.

From those microscopic pictures, we can see that the metallographical texture of an embodiment of the present invention has a fine texture.

Moreover, as it is apparent also from the microscopic picture expanded at a magnification of 100000 indicated in FIG. 4(B), fine carbon nitride mainly composed of added elements is precipitated on the ferrite, showing improved strength of the forged material.

What is claimed is:

1. A method of forging a material, said method comprising:

adding a second material to steel to obtain a third material, the second material comprising at least one metal from the group consisting of group VB metals;

heating the third material to a temperature in a range of 1150–1250° C.;

forging the heated third material to a prescribed shape;

cooling the forged third material;

holding the cooled forged third material in a tempering temperature area of a furnace at a temperature in a range of 500–700° C.; and cooling the cooled forged material to a normal temperature by natural cooling, so that carbon and nitrides that include the second material precipitate on the steel.

2. The method of claim 1, wherein said holding comprises holding the cooled forged material for 30–60 minutes.

* * * * *